US011905047B2

(12) United States Patent
Cox et al.

(10) Patent No.: US 11,905,047 B2
(45) Date of Patent: Feb. 20, 2024

(54) DEVICE AND METHOD FOR FORMING BUNDLES OF INDIVIDUAL PACKAGES

(71) Applicant: KHS GmbH, Dortmund (DE)

(72) Inventors: Bernd Cox, Weeze (DE); Michael Jörissen, Bedburg-Hau (DE)

(73) Assignee: KHS GmbH, Dortmund (DE)

( * ) Notice: Subject to any disclaimer, the term of this patent is extended or adjusted under 35 U.S.C. 154(b) by 196 days.

(21) Appl. No.: 17/631,650

(22) PCT Filed: Jul. 15, 2020

(86) PCT No.: PCT/EP2020/069969
§ 371 (c)(1),
(2) Date: Jan. 31, 2022

(87) PCT Pub. No.: WO2021/018587
PCT Pub. Date: Feb. 4, 2021

(65) Prior Publication Data

US 2022/0281625 A1 Sep. 8, 2022

(30) Foreign Application Priority Data

Aug. 1, 2019 (DE) ..... 102019120789.4

(51) Int. Cl.
*B65B 11/10* (2006.01)
*B65B 57/02* (2006.01)
(Continued)

(52) U.S. Cl.
CPC ..... *B65B 11/10* (2013.01); *B65B 51/023* (2013.01); *B65B 57/02* (2013.01); *B65B 2011/002* (2013.01)

(58) Field of Classification Search
None
See application file for complete search history.

(56) References Cited

U.S. PATENT DOCUMENTS 5,189,865 A * 3/1993 Andrade ..... B65B 25/14 53/228
8,967,942 B2 * 3/2015 Torsten ..... B65G 57/303 414/788.9

(Continued)

FOREIGN PATENT DOCUMENTS

CN 109178438 A 1/2019
DE 4307934 A1 9/1993

(Continued)

OTHER PUBLICATIONS

International Search Report, PCT Application No. PCT/EP2020/069969, dated Nov. 5, 2020 (4 pages).

*Primary Examiner* — Tanzim Imam
(74) *Attorney, Agent, or Firm* — Occhiuti & Rohlicek LLP

(57) ABSTRACT

A transport unit transports a package combination through a wrapping unit that wraps it with a cutout such that a front end of the cutout and a rear end of the cutout are arranged to overlap each other while lying on the transport unit. The transport unit includes a wrapping belt that passes through the wrapping unit for conveying the combination along a transport plane from an inlet to an outlet. The wrapping belt comprises long belts and short belts that are parallel to each other and that circulate in a transport direction. The long belts extend from the wrapping-belt inlet to the wrapping-belt outlet and the short belts extends from the wrapping-belt inlet as far as an end region that falls short of the wrapping-belt outlet. Each of the short belts is arranged between a pair of the long belts, thereby forming free spaces between the long belts.

17 Claims, 7 Drawing Sheets

(51) Int. Cl.
*B65B 51/02* (2006.01)
*B65B 11/00* (2006.01)

(56) References Cited

U.S. PATENT DOCUMENTS

| | | | | |
|---|---|---|---|---|
| 2002/0139090 | A1* | 10/2002 | Antoniazzi | B65B 35/58<br>53/228 |
| 2006/0037290 | A1* | 2/2006 | Smith | B65B 43/10<br>53/566 |
| 2010/0038210 | A1* | 2/2010 | Cox | B65G 23/26<br>198/460.1 |

FOREIGN PATENT DOCUMENTS

| | | | |
|---|---|---|---|
| DE | 69101786 | T2 | 9/1994 |
| DE | 102008052633 | A1 | 4/2010 |
| EP | 1227040 | A1 | 7/2002 |
| EP | 1403181 | A1 | 3/2004 |
| GB | 2258205 | A | 2/1993 |

* cited by examiner

DEVICE AND METHOD FOR FORMING BUNDLES OF INDIVIDUAL PACKAGES

RELATED APPLICATIONS

This is the national stage of international application PCT/EP2020/069969, filed on Jul. 15, 2020, which claims the benefit of the Aug. 1, 2019 priority date of German application DE 102019120789.4, the contents of which are herein incorporated by reference.

FIELD OF INVENTION

The invention relates to a device for forming bundles of individual packages, in particular liquid containers, by wrapping a package combination of grouped individual packages in a cutout made of a packaging material.

BACKGROUND

It is known to wrap containers into bundles to be sold as a unit. A typical material for such wrapping is plastic film, which can be heated so as the shrink. The resulting shrinkage is particularly effective at holding containers in position.

Containers that are bundled in this way range the gamut from primary packages for beverages and liquid foodstuffs, such as, in particular, bottles, cans, beakers, and pouches, or cubic carton packaging with or without spouts. These liquid containers can consist of one or more known materials, such as glass, plastic, metal, or cardboard.

In known systems, a combination of such packages that are to be bundled together are transported on a belt through a wrapping machine. In some cases, the packages are placed on a tray, such as a cardboard tray, to promote stability.

The excessive use of plastic has become frowned upon in recent years. However, the desire to bundle packages remains. Thus, it is useful to consider the use of other materials, and in particular, paper, as an alternative. With the use of paper as a material for bundling, it becomes necessary, at some point, to apply adhesive. This turns out to be difficult to do in a mass production setting, particularly in a way that maintains the taut contact of the wrapping material that forms the package.

SUMMARY

An object of the invention is that if reliably applying adhesive onto a cutout arranged in the region between a wrapping belt and a package combination.

Characteristic of the device according to the invention is the fact that the wrapping belt comprises a number of individual belts arranged to be circulating in the transport direction, parallel to one another and spaced apart such as to form a free space, wherein the wrapping belt comprises a first group of individual belts, configured as full belts, extending from the wrapping belt inlet as far as the wrapping belt outlet, and a second group of individual belts, configured as partial belts, extending from the wrapping belt inlet as far as into an end region before the wrapping belt inlet which forms a free space, and wherein in each case a partial belt is arranged adjacent to a full belt.

The wrapping belt extends from a wrapping belt inlet, where it takes over a package combination of grouped individual packages which are to be wrapped, as far as a wrapping belt outlet, at which the package combination, at least very largely wrapped in the cutout, is transported away from the wrapping unit.

The wrapping belt is not formed from one single belt body but instead comprises at least two types of individual belts having different lengths. The individual belts include "full belts" that extend from the wrapping belt inlet as far as the wrapping belt outlet. The individual belts also include "partial belts" that extend from the wrapping belt inlet but only as far as a a region in front of the wrapping belt outlet, i.e. the partial belts end, seen in the transport direction, spaced at a distance in front of the wrapping belt outlet.

As a result of the alternating arrangement of partial belts and full belts transverse to the transport direction, the wrapping belt therefore comprises a section in an end region, facing towards the wrapping belt outlet, over which only the full belts extend. As a result, in this region sufficiently large free spaces are provided between the full belts, while maintaining an adequate transport effect in relation to the package combination, by means of which appropriate function units can come into functional contact with the cutout.

For example, the free spaces allow for the convenient application of adhesive by means of a function unit, configured as an adhesive application unit, through the wrapping belt onto the cutout located in contact with the wrapping belt. The application of adhesive can therefore be applied in a manner by means of which it can be reliably guaranteed that a rear end, which is then laid onto the front end of the cutout, is reliably fixed, such that a taut arrangement of the cutout on the package combination, produced by the wrapping unit, is maintained.

The packaging material from which the cutout is formed can be, for example, a paper material. In other words, the cutout can consist of a paper material.

The dimension of the end region of the wrapping belt that results from the different lengths of partial belts and full belts, in which the transport effect is only achieved by the full belts, is in principle freely selectable. According to one particularly advantageously embodiment, however, the partial belts are shorter than the full belts by 10% to 50%, preferably by 20% to 40%, and particularly preferably 25% to 35%. As a result of this embodiment of the invention, an adequately long end region of the wrapping belt is provided, seen in the transport direction, in which the free spaces are determined by the spacing interval between the full belts, and by means of which a reliable application of adhesive onto the cutout can be achieved, which is sufficient to ensure the reliable fixing of a rear end of a cutout which is applied onto the front end.

The arrangement of a function unit, such as an adhesive application unit, for applying adhesive onto the cutout, or of other function units coming into reciprocating effect with the cutout, can in principle be located at any desired point in the end region, provided that the desired reciprocal effect with the cutout is achieved. According to one advantageous further embodiment of the invention, however, a function space is provided to receive a function unit, which, in the transport direction, beneath at least one working strand of the full belts and between the rear end or rear deflection of at least one of the partial belts, is spanned by the rear end of at least one of the full belts. Preferably, in the transport direction, the function space extends over a region between a rear deflection of at least one partial belt and the removal belt, in particular between a working strand and an empty strand of the full belts, and transverse to the transport direction.

The arrangement of a function unit in a free space which is delimited in accordance with a further embodiment of the invention, due to the spatial proximity to the cutout, ensures a particularly reliable interaction of the function unit with the cutout. A deficient interaction of function unit and cutout can therefore be particularly reliably avoided.

This relates in particular to the arrangement of the function unit in a region which is delimited by the empty strand and the working strand of the full belts, wherein, related to the position of use, the function unit is then arranged beneath the full belts moving in the transport direction and above them moving counter to the transport direction, in immediate proximity to the cutout, where these can come into reciprocal working effect with the cutout particularly reliably over the free spaces.

The configuration of the function unit which can be arranged in the free space and can be brought into reciprocal working effect with the cutout is freely selectable. According to a further embodiment of the invention, however, provision is made that, by means of at least one function unit in the function space, at least one end of the cutout can be detected and/or monitored and/or treated by means of sensors, and in particular an adhesive can be applied.

The possibility of the arrangement of one or more function units provides for a particularly reliable reciprocal working effect of the individual function units with the cutout. For example, it is possible for the cutout to be detected particularly free of any errors by means of a suitable function unit configured as a sensor unit. An activation of adhesive or an application of adhesive can be put into effect particularly exactly by a function unit configured as an adhesive application unit, wherein, at the activation of the adhesive, the adhesive application unit takes effect in a corresponding manner on the cutout. The sensor units allow for a tactile or contactless detection of the position of the cutout on the wrapping belt.

The arrangement of the adhesive application unit for the application of an adhesive onto the underside of the package combination can in principle be in any desired manner in relation to the wrapping belt. According to one particularly advantageous embodiment of the invention, however, provision is made that the function unit configured as an adhesive application unit, for the application of adhesive onto the underside of the package combination, is arranged in the region of the free spaces. An arrangement in the region of the free spaces, for example in such a way that the adhesive application unit is arranged inside the circulating full belts, allows for a particularly exact application of the adhesive onto the cutout. For this purpose the adhesive application unit can comprise suitable nozzles, which ensure a predetermined adhesive application into the regions of the cutout provided for this purpose.

According to a further embodiment of the invention, provision is made that the wrapping belt comprises a protective plate in the region of a belt deflection of the partial belts, facing towards the wrapping band outlet, which screens the partial belts from the adhesive application unit. According to this embodiment of the invention, a protective plate is arranged between the belt deflection of the short partial belts, which protects the short belts, in particular the deflection region, for example against being loaded with an adhesive resulting from a spray mist. Contamination by adhesive of the outer sides of the partial belts which are in contact with the package combinations is therefore effectively avoided.

In order to increase the security of the adhesive application onto the cutout, according to a further embodiment of the invention a function unit configured as a sensor unit is provided for detecting the package combination in a working region of the adhesive application unit. By means of the sensor unit, the arrangement of the package combination in the end region of the wrapping belt can be detected in a reliable manner, in which, by means of the adhesive application unit, an adhesive can be applied onto the cutout, for example at certain points or distributed in a predetermined manner. The sensor unit therefore increases the reliability of the application of the adhesive onto the cutout in a region intended for this in a supplementary manner.

According to a further embodiment of the invention, provision is further made that the transport unit comprises a removal belt connecting to the wrapping belt in the transport direction, wherein the wrapping belt has a belt speed which is higher, in particular 1.25 to 2 times higher, than the removal belt, such that the rear end of the cutout, at the transfer of the package combination from the wrapping belt onto the removal belt, is pre-tensioned in the direction onto the front end of the cutout.

According to this further embodiment of the invention, provision is made that the removal belt and the wrapping belt have belt speeds which differ from one another, wherein the removal belt arranged in the transport direction behind the wrapping belt has a lower belt speed. During the transport through the wrapping unit in the transport direction, the package combination is intermittently in engagement with both the removal belt as well as with the wrapping belt. During this transfer of the package combination from the wrapping belt onto the removal belt, the rear end of the cutout is guided under the front end of the cutout. Due to the slower belt speed of the removal belt in relation to the wrapping belt, in this situation the cutout, for example a paper cutout, is put under tension and tautened, wherein a wrapped over rear end of the paper cutout is drawn in the direction of its front end. As a result of this, overall, in a circumferential direction of the package combination corresponding to the transport direction, a taut contact of the paper cutout on the package combination is achieved. As a result of this, in a particularly convenient manner, the possibility is provided of the production of a bundle formed as a stable packaging unit, making use of a packaging cutout formed from paper material, which represents a significantly more environmentally friendly packaging material than plastic materials.

The method according to the invention for the monitoring and/or handling of a cutout enclosing a package combination by means of a function unit and making use of a device as described here is characterized by having the function unit be arranged in an end region on a side of the wrapping belt facing away from the cutout, and in particular, in a function space between a work strand and an empty strand of the full belts, and by having it be in working connection with the cutout through the free space formed between the full belts.

The arrangement of the function unit in the manner provided for by the method described herein, due to its arrangement in immediate proximity to the cutout that is to be processed, handled, or monitored, allows for a particularly fault-free interaction of the respective function unit with the cutout. In the case of the configuration of the function unit as a sensor unit for detecting the cutout in the end region of the wrapping belt, the detection can be carried out particularly reliably through the free spaces in a tactile or contactless manner, for example by suitable optical sensors. The free spaces also create the possibility, in a reliable manner, for an adhesive which is already arranged on the cutout to be activated, or for an adhesive to be applied in an exactly predetermined manner onto the cutout by means of suitable nozzles. The method therefore allows for particularly reliable processing, monitoring, and/or handling of the cutout by the function unit provided for the respective process.

Particularly advantageously, provision is made in this situation that the function unit detects the cutout by means of sensors, monitors, and/or treats it optically, in particular applying an adhesive onto the cutout. In this situation, function units can be used that are configured for carrying out several processes or individual function units can be arranged in a suitable manner adjacent to one another in the function space.

According to a particularly advantageous embodiment of the invention, provision is further made for the function unit to be adjusted in relation to the cutout. An adjustment of the function unit in relation to the cutout inside the free space allows for an exact alignment of the function unit in relation to the cutout such that the respective work processes to be carried out by the cutout can be performed particularly reliably.

It is particularly advantageous if one of the function units acts as a sensor and is, for example, a laser position-sensor or a camera, that detects and monitors the relative position between one or more individual packages and one or more sides of the cutout. As an alternative, the adhesive applied onto the cutout can be applied in the interaction with the individual packages or one or more sides of the cutout. The data acquired in this way can then be used for control purposes, such as the alignment and orientation of the cutout or for the application of an amount of of the adhesive. In the event of an application of a hot or melt adhesive, one of the function units can advantageously be a heat-imaging camera. As a result of this, the presence of the adhesive, the actual temperature, and the expansion of the adhesive over the surface, and therefore its quantity, can be monitored and continuously controlled.

As used herein, "full belt" and "partial belt" will also be referred to as "long belt" and "short belt" respectively.

BRIEF DESCRIPTION OF THE DRAWINGS

These and other features of the invention will be apparent from the following detailed description and the accompanying figures, in which.

DETAILED DESCRIPTION

Figure 1:
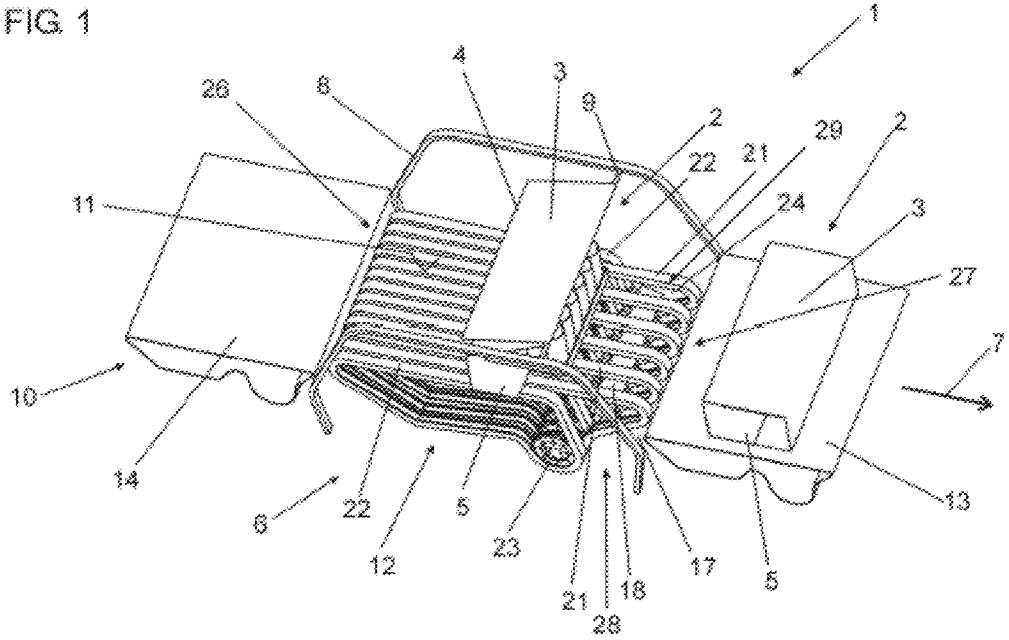
FIG. 1 is perspective view of a bundling machine.
Figure 2:
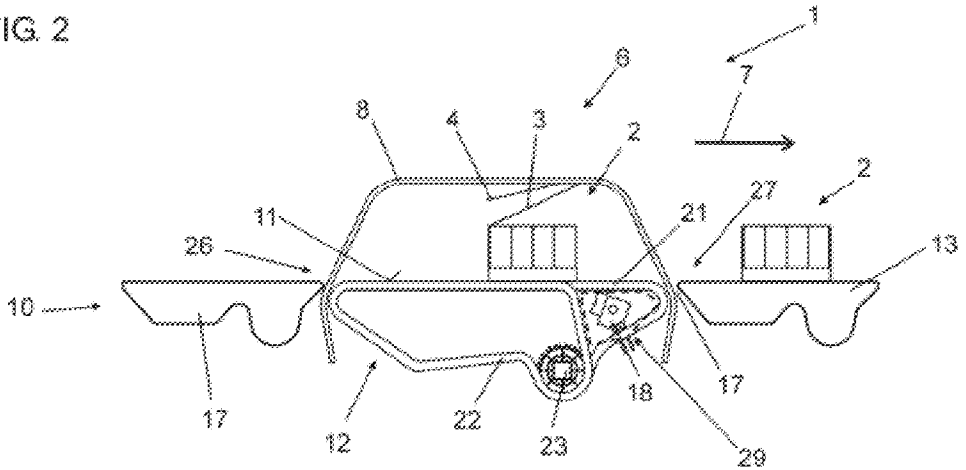
FIG. 2 is a side view of the bundling machine shown in FIG. 1.

FIG. 1 shows a perspective view bundling machine 1 having of a transport unit 10. FIG. 2 shows a side view of the bundling machine 1 shown in FIG. 1.

The transport unit 10 comprises a conveyor belt 14, a wrapping belt 12 downstream from the conveyor belt 14, and a removal belt 13 downstream from the wrapping belt 12. These belts 14, 13, 23 all run in a transport direction 7.

The conveyor belt 14 transports a package combination 2, which comprises individual packages, to the wrapping belt 12. The wrapping belt 12 transports the combination 2 through a wrapping unit 6 between a wrapping-belt inlet 26 and a wrapping-belt outlet 27. At the wrapping-belt outlet 27, the removal belt 13 receives the now wrapped combination 2.

The wrapping unit 6 wraps the combination 2 in a paper cutout 3. The cutout 3 has a front end 5 and a rear end 4. The front end 5 lays on the wrapping belt 12. During the wrapping process, the combination 2 stands upright on this front end 5.

As the combination 2 moves through the wrapping unit 6, a guide rod 9 wraps a rear end 4 of the cutout 3 around the combination 2. Guide rails 8 arranged on either side of the wrapping belt 12 guide the guide rod 9 as it does so.

Figure 3A:
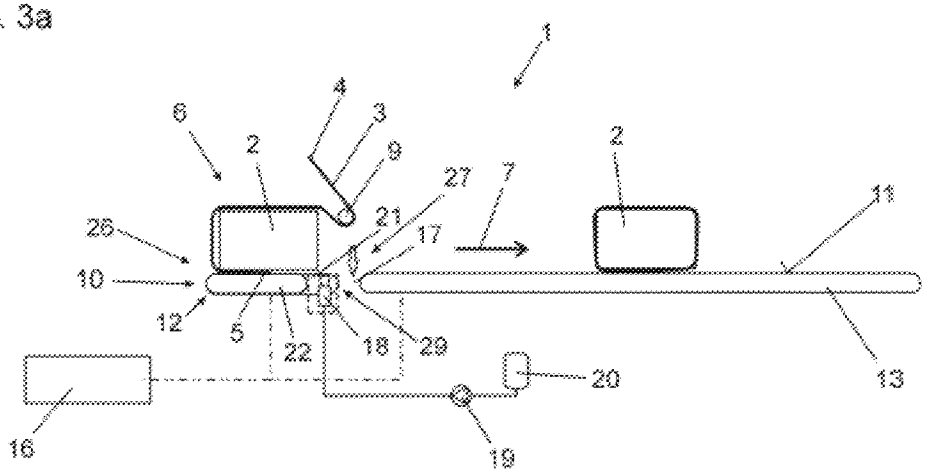
FIGS. 3*a*-3*c* show different stages in the operation of the wrapping unit shown in FIGS. 1 and 2.
Figure 3B:
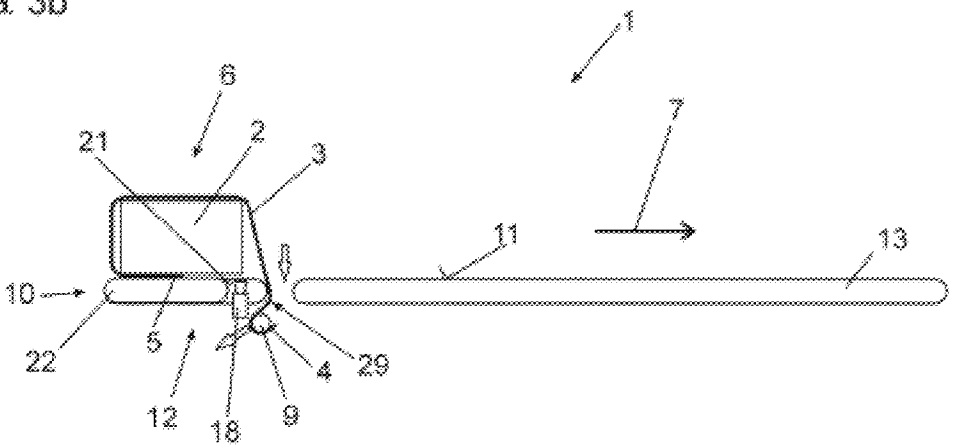
Figure 3C:
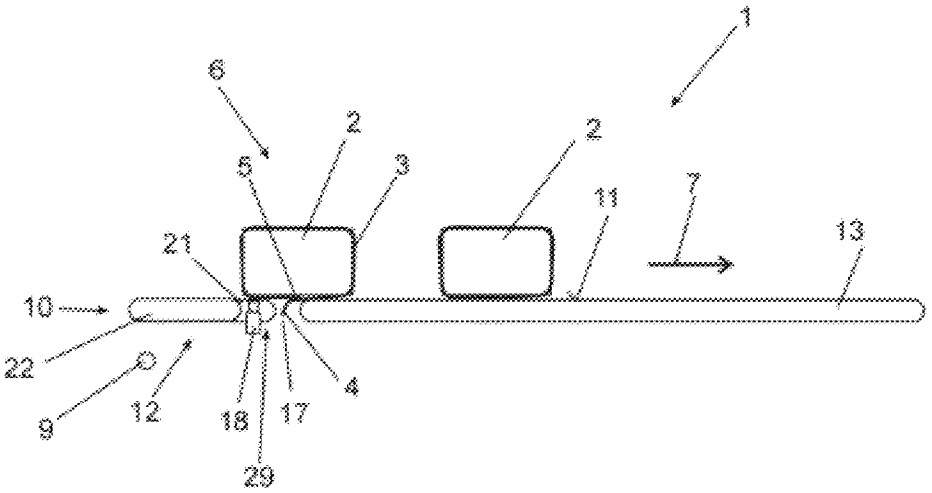

As can be seen in FIGS. 3*a*-3*c*, the guide rod 9 guides the rear end 4 of the cutout 3 through a gap 17 between the wrapping belt 12 and the removal belt 13 into a region below a transport plane 11 defined by the top surface of the wrapping belt 12. The rear end 4 is eventually laid onto the front end 5 at the combination's underside, as can be seen in FIG. 3*c*.

The wrapping belt 12 comprises long belts 21 and short belts 22 that are arranged parallel to one another in alternating order, as a result of which a pair of long belts 21 will have a short belt 22 between them. The short belts 22 and the long belts 21 all move together in the transport direction 7.

The long belts 21 extend as far as the wrapping-belt outlet 27. The short belts 22 fall short of reaching the wrapping-belt outlet 27. As a result, in an end region 28 of the wrapping belt 12, there will be free spaces 24 between long belts 21. As is apparent from the figures, some of the long belts 21 support a combination 2 and others do not. These are referred to herein as "working strands" and "empty strands."

A function unit 18 lies in a function space 29 that is under the long belts 21 within the end region 28. In the illustrated embodiment, the function unit 18 is an adhesive applicator 18. A pump 19 pumps the adhesive to the adhesive applicator 18 from a tank 20, shown in FIG. 3*a*. However, other kinds of function unit 18 can be placed in the function space 29.

Using nozzles that are aligned with the free spaces 24 and directed upwards towards a combination 2 that passes across the end region 28, the adhesive applicator 18 applies adhesive through the free spaces 24 to the cutout 3 on the underside of the combination 2. This occurs as the combination 2 is being transferred to the removal belt 13. At this time, the rear end 4 is fixed to the front end 5 of the cutout.

Figure 4:
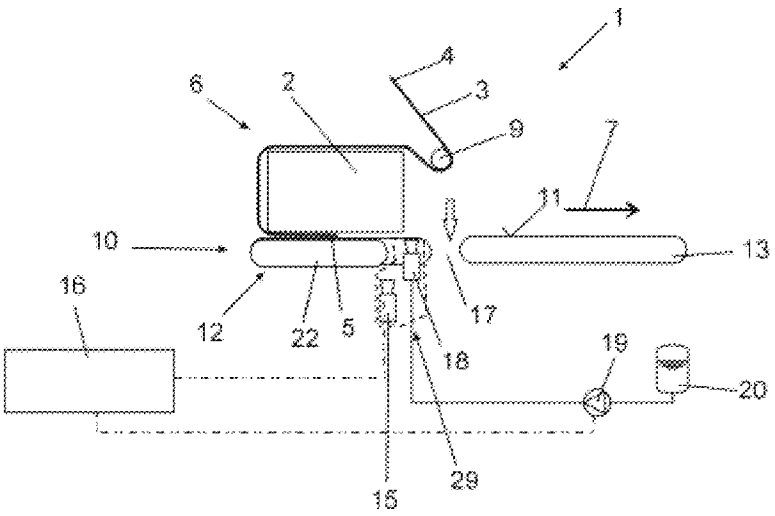
FIG. 4 shows the bundling machine of FIG. 1 with a sensor to detect the presence of a package combination.
Figure 5:
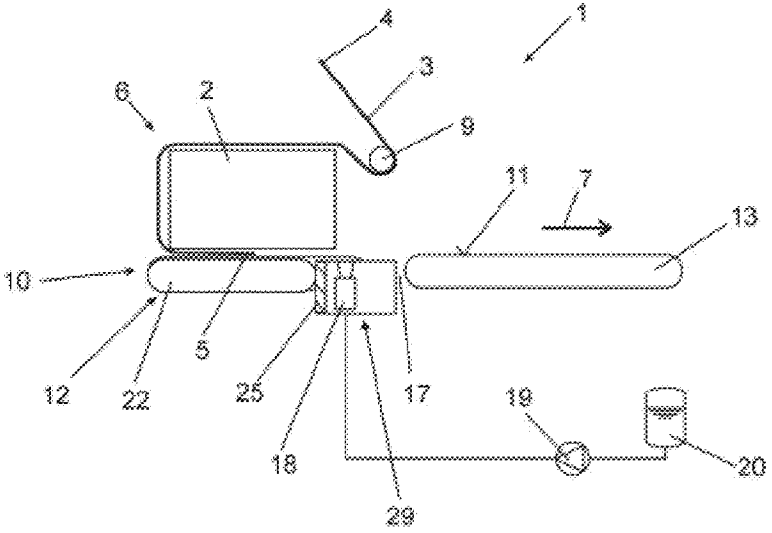
FIG. 5 shows the bundling machine of FIG. 1 with a protective plate to protect the belts against stray adhesive.

Referring now to FIG. 4, a sensor unit 15 directed to look through the free spaces 24 detects the arrival of a package combination 2 at the end region 28 and provides a signal to a controller 16 that then causes the adhesive applicator 18 to apply adhesive. The controller 16 also controls movement of the wrapping belt 12 and the removal belt 13.

Having described the invention and a preferred embodiment thereof, what is claimed as new and secured by letters patent is:

1. An apparatus for forming bundles of liquid-filled containers by wrapping a combination of grouped packages in a cutout, said apparatus comprising a wrapping unit and a transport unit that transports said combination in a transport direction through said wrapping unit, wherein said wrapping unit wraps said combination with said cutout such that a front end of said cutout and a rear end of said cutout are arranged to overlap each other while lying on said transport unit, wherein said transport unit comprises a wrapping belt that passes through said wrapping unit for conveying said combination along a transport plane from a wrapping-belt inlet to a wrapping-belt outlet, wherein said wrapping belt comprises long belts and short belts that are parallel to each other and that circulate in the transport direction, wherein said long belts extend from said wrapping-belt inlet to said wrapping-belt outlet and said short belts extends from said wrapping-belt inlet to an end region that falls short of reaching said wrapping-belt outlet, and wherein each of said short belts is arranged between a pair of said long belts, thereby forming free spaces between said long belts.

2. The apparatus of claim 1, wherein said short belts are shorter than said long belts by between 10% and 50%.

3. The apparatus of claim 1, wherein said short belts are shorter than said long belts by between 20% and 40%.

4. The apparatus of claim 1, wherein said short belts are shorter than said long belts by between 25% and 35%.

5. The apparatus of claim 1, further comprising a function space and a function unit that is received within said function space, wherein said function space extends transverse to said transport direction upstream of a removal belt between a working strand and an empty strand of said long belts.

6. The apparatus of claim 1, further comprising a function space, an adhesive applicator within said function space, and a sensor, wherein said sensor is configured to detect an end of said cutout and to provide a signal for use in causing said adhesive applicator to apply adhesive to said cutout.

7. The apparatus of claim 1, further comprising an adhesive applicator below said transport plane, said adhesive applicator being configured to apply adhesive through said free spaces onto an underside of said combination.

8. The apparatus of claim 1, further comprising a protective plate that screens the short belts and an adhesive applicator below said transport plane, said adhesive applicator being configured to apply adhesive through said free spaces onto an underside of said combination and said protective plate being configured to protect said short belts from stray adhesive.

9. The apparatus of claim 1, further comprising a sensor that is configured to detect presence of said combination in a working region of an adhesive applicator that is disposed to apply adhesive to said cutout.

10. The apparatus of claim 1, wherein said transport unit further comprises a removal belt downstream of said wrapping belt in said transport direction, wherein said wrapping belt runs up to twice as fast as said removal belt thereby creating a speed differential and wherein said rear end of said cutout is pre-tensioned when being transferred to said removal belt as a result of said speed differential.

11. The apparatus of claim 1, further comprising an optical sensor that is configured to detect presence of said combination in a working region of an adhesive applicator that is disposed to apply adhesive to said cutout.

12. A method of using an apparatus for forming bundles of liquid-filled containers by wrapping a combination of grouped packages in a cutout, said apparatus comprising a wrapping unit and a transport unit that transports said combination in a transport direction through said wrapping unit, wherein said wrapping unit wraps said combination with said cutout such that a front end of said cutout and a rear end of said cutout are arranged to overlap each other while lying on said transport unit, wherein said transport unit comprises a wrapping belt that passes through said wrapping unit for conveying said combination along a transport plane from a wrapping-belt inlet to a wrapping-belt outlet, wherein said wrapping belt comprises long belts and short belts that are parallel to each other and that circulate in said transport direction, wherein said long belts extend from said wrapping-belt inlet to said wrapping-belt outlet and said short belts extends from said wrapping-belt inlet to an end region that falls short of reaching said wrapping-belt outlet, wherein each of said short belts is arranged between a pair of said long belts, thereby forming free spaces between said long belts, and, wherein said method includes arranging a function unit at said end region in a function space on a side of said wrapping belt that faces away from said cutout, said function unit interacting with said cutout through said free spaces between said long belts.

13. The method of claim 12, further comprising sensing a displacement between a package and a side of said cutout and forwarding data indicative of said displacement to a controller.

14. The method of claim 12, further comprising sensing a displacement between adhesive applied to said cutout and a package and forwarding data indicative of said displacement to a controller.

15. The method of claim 12, further comprising sensing a displacement between adhesive applied to said cutout and a side of said cutout and forwarding data indicative of said displacement to a controller.

16. The method of claim 12, further comprising adjusting said function unit in relation to said cutout.

17. The method of claim 12, further comprising detecting a signal indicative of presence of said cutout in said free spaces and applying adhesive onto said cutout using said function unit.

* * * * *